US012484652B2

(12) United States Patent
Kuschnigg et al.

(10) Patent No.: US 12,484,652 B2
(45) Date of Patent: Dec. 2, 2025

(54) SPORT HELMET ASSEMBLY

(71) Applicant: ATOMIC Austria GmbH, Altenmarkt im Pongau (AT)

(72) Inventors: Peter Kuschnigg, Bad Reichenhall (DE); Daniel Rietzler, Sankt Johann im Pongau (AT); Peter Wirthenstätter, Oberalm (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 18/884,205

(22) Filed: Sep. 13, 2024

(65) Prior Publication Data

US 2025/0107588 A1 Apr. 3, 2025

(30) Foreign Application Priority Data

Sep. 28, 2023 (AT) ..... A 50794/2023

(51) Int. Cl.
*A42B 3/22* (2006.01)

(52) U.S. Cl.
CPC ..... *A42B 3/223* (2013.01); *A42B 3/22* (2013.01); *A42B 3/221* (2013.01)

(58) Field of Classification Search
CPC ..... A42B 3/223; A42B 3/22; A42B 3/221; A42B 3/185; A42B 3/222
See application file for complete search history.

(56) References Cited

U.S. PATENT DOCUMENTS

| | | | | |
|---|---|---|---|---|
| 2004/0172739 | A1* | 9/2004 | Racine | A42B 3/324 2/418 |
| 2010/0229288 | A1* | 9/2010 | Higgins | G02B 27/0176 2/10 |
| 2012/0185989 | A1 | 7/2012 | Higgins | |
| 2015/0201696 | A1* | 7/2015 | Pfanner | A42B 3/222 2/424 |
| 2018/0242677 | A1 | 8/2018 | Pilenga | |
| 2019/0357624 | A1 | 11/2019 | Rietzler | |
| 2023/0136136 | A1* | 5/2023 | Deheselle | A42B 3/223 2/424 |
| 2025/0107588 | A1* | 4/2025 | Kuschnigg | A42B 3/185 |

FOREIGN PATENT DOCUMENTS

| | | | |
|---|---|---|---|
| AT | 521369 | B1 | 1/2020 |
| DE | 10 2016 116 999 | A1 | 3/2017 |
| EP | 3 195 745 | A1 | 7/2017 |
| EP | 3 366 153 | A1 | 8/2018 |
| EP | 3 970 545 | A1 | 3/2022 |

* cited by examiner

*Primary Examiner* — Khaled Annis

(74) *Attorney, Agent, or Firm* — Collard & Roe, P.C.

(57) ABSTRACT

A sport helmet assembly includes a helmet with a helmet shell and a visor. On its front side, the helmet shell with a helmet shell edge defines an upwardly-limited facial clearance. The visor includes upper and lower visor edge regions. A left bearing arrangement for the visor has a left sliding guide and a left pivot axis, and a right bearing arrangement for the visor has a right sliding guide and a right pivot axis for pivoting and displacing the visor by the bearing arrangements during a manually executed displacement movement. An available displacement length of the sliding guides and a thickness of the sealing element on the visor measured from a visor inner side in the direction of a helmet rear head side are dimensioned such that the sealing element is pressable against face portions below the user's eyes in the visor closed position by the sliding guides.

14 Claims, 6 Drawing Sheets

SPORT HELMET ASSEMBLY

CROSS REFERENCE TO RELATED APPLICATIONS

Applicant claims priority under 35 U.S.C. § 119 of Austrian Application No. A50794/2023 filed Sep. 28, 2023, the disclosure of which is incorporated by reference.

BACKGROUND OF THE INVENTION

1. Field of the Invention

The invention relates to a sport helmet assembly comprising a helmet and a visor mounted thereon, the latter being adjustable as required by the user as indicated in the claims.

2. Description of the Related Art

There are sport helmet assemblies, in which the helmet with its helmet shell is not configured as a full-face helmet, and the otherwise open facial area of the user or the wearer of the helmet is covered by the folded-down visor to form the protective position, in particular for the eye area. For example, when practicing sports such as skiing, the head wind and any precipitation also occurring are prevented from directly reaching the eyes.

AT521369B1, also belonging to the applicant, describes a sport helmet assembly comprising a helmet with a helmet shell, a visor and a bearing device with a left and right bearing arrangement. The visor is pivotably mounted on the helmet shell by means of the bearing arrangements and can be displaced between a protective position substantially covering a face opening and a release position substantially releasing the face opening. The helmet defines a support portion for the visor in the region of its helmet shell edge that delimits the face opening. Each of the pivot axes is displaceable from an upper position closer to a helmet shell upper side into a lower position at a further distance to the helmet shell upper side. As a result, the sport helmet assembly can be better adapted to the different requirements of those who wear glasses and those who do not. However, the usability of this sport helmet assembly is only partially satisfactory in the context of a broader range of varying head sizes or face shapes.

SUMMARY OF THE INVENTION

The object of the present invention was to overcome the disadvantages of the prior art and to provide a sport helmet assembly that best protects the facial area of a broader range of users from weather influences, but is nevertheless comfortable for the users and as easy as possible to handle.

This problem is solved by a sport helmet assembly according to the invention.

The sport helmet assembly according to the invention comprises a helmet with a helmet shell, said helmet being configured to at least partially receive a head of a user to be protected, wherein the helmet shell on its front side with a helmet shell edge defines a facial clearance limited upwards, i.e. in the direction of the forehead, and this facial clearance is not limited downwards, i.e. in the direction of the chin, by the helmet shell. The helmet is accordingly configured to be chinless or a so-called half-shell helmet, which can be advantageously implemented in a lightweight manner and be very comfortable to wear. In particular, the helmet is not a so-called full-face or integral helmet with a facial clearance completely enclosed by the helmet shell. The helmet shell also forms a helmet shell upper side and a temple region on both sides. However, a structurally independent chin guard, which can be expedient for practicing certain winter sports, can be attached to the helmet shell, in particular mounted on the temple areas of the helmet shell.

The sport helmet assembly further comprises a visor, said visor having an upper visor edge region and a lower visor edge region, wherein the lower visor edge region can be turned to face closest to a nose or a chin of the user. The sport helmet assembly further comprises a bearing device with a left bearing assembly and a right bearing assembly for the visor, said bearing assemblies are each arranged or formed in one of the temple regions on the helmet shell, wherein the left bearing assembly defines at least one left pivot axis and the right bearing assembly defines at least one right pivot axis, so that the visor can be displaced between a closed position or protective position, which substantially covers the facial clearance, and an open position or release position, which largely releases the facial clearance, and vice versa. The sport helmet assembly further comprises a form-elastic sealing element, which is secured in the lower visor edge region of the visor and extends at least in sections along the lower visor edge region.

It is essential for this generic sport helmet assembly that the left bearing arrangement has a left sliding guide in addition to the left pivot axis, and that the right bearing arrangement has a right sliding guide in addition to the right pivot axis such that the visor can be pivoted and displaced by the user by means of the bearing arrangements on the helmet shell during a manually executed displacement movement. Accordingly, the visor is attached to the helmet by means of a left and right sliding joint. It is also essential that a structurally predetermined or available displacement length of the left and right sliding guide and a thickness of the sealing element measured from an inner side of the visor in the direction of a rear head side of the helmet are dimensioned such that the sealing element at the lower visor edge region can be pressed against face portions below the eyes of the user in the closed position of the visor by means of the left and right sliding guide. The sealing element preferably extends in the lower visor edge region of the visor such that the former can also be pressed or placed against the corresponding facial surfaces of the user in the region between the eyes or in the region of the bridge of the nose and can thus develop a comprehensive sealing or partitioning effect against drafts or cold air.

As a result of the measures indicated, the sealing element is pressed frontally or tendentially in the normal direction (predominantly at right angles) against the facial surfaces of the user and is not pushed against the areas of the face the user in a shearing manner by a pivoting movement starting from the pivot axes. The specified measures can ensure that the sealing element is pressed as much as possible against the associated parts of the face off the respective user. Shear forces acting on a part of the face can be avoided or are minimal to unnoticeable. As a result, high wearing comfort of the sport helmet assembly can be achieved in relation to various parts of the face. However, it is also possible to achieve a significant seal against undesired drafts or weather, at least in the area of the eyes of the user, for a relatively wide range of different head sizes and face shapes. The comprehensive adaptability of the sport helmet assembly or its visor to a large number of users is does not require the use of tools.

The sport helmet assembly according to the invention can also be configured to be as lightweight as possible and nevertheless relatively sealed against drafts or cold air in the region of the eye areas of a user. In comparison, a full-face helmet with a fully limited facial clearance and with a visor arranged in front of this facial clearance would tend to be relatively heavy and would only be able to protect moderately from drafts or cold air in the area below the eye areas because drafts or damp-cold air can enter behind the visor via the open portion below the chin guard.

The left pivot axis and the left sliding guide can be parts of a left sliding joint and the right pivot axis and the right sliding guide can be parts of a right sliding joint.

It can further be expedient for at least one of the two sliding guides, preferably both the left and the right sliding guide, to be assigned at least one spring element, with said at least one spring element the visor is pushed in the direction of an end position or pressing position closest to the rear head side. The at least one spring element can be configured as a helical spring, in particular as a helical compression spring. By means of this at least one spring element, conventional ski goggles with a rubber band or band tension attachment can virtually be imitated to the greatest possible extent, in particular in terms of wearing or use behavior. By doing so, it is possible to create a sport helmet assembly that is particularly suited to practicing winter sports, in particular skiing. The spring force of the at least one spring element can be adjusted or dimensioned in a simple manner such a that, on the one hand, a reliable sealing effect or a partial compression of the sealing element takes place in the lower visor edge region, and, on the other hand, no unpleasant pressure points occur on the facial surfaces of the user.

It can further be provided that the spring force of the at least one spring element is dimensioned such that the visor can be displaced into at least one distance position comparatively further away from the rear head side by the user by gripping the visor, in particular by grasping the visor in each of the two temple regions. By doing so, it is possible to manually lift the visor relative to the face of the user without having to loosen or remove the helmet from the head of the user. An advantage of this measure is also that the visor can be moved from a covering or limiting position in relation to the helmet shell edge and can subsequently be pivoted upwards into its open or release position without hindrance. In addition, the corresponding operating action is implemented in an intuitive manner for a large number of users and can also be carried out relatively easily when wearing gloves.

It can particularly be provided that, in the closed position of the visor, the helmet shell edge projects beyond the upper visor edge region at least in sections in the direction of the front side, in particular at least in the central portion between the left and right bearing arrangement such that, in this closed or use position of the visor, pivoting of the visor at least in the direction of the open position is blocked by the projecting helmet shell edge or the projecting helmet protrusion or is prevented in a stop-limited manner. As a result, high stability and robustness of the sport helmet assembly can be achieved. In particular, this can prevent mechanical overloads of the left and right bearing arrangement of the visor. In addition, a "roof overhang" is created, with which water or snow ingress can be avoided and wetting of the inside of the visor can be prevented.

An embodiment is also advantageous, according to which it can be provided that the left sliding guide comprises a left linear guide element and the right sliding guide comprises a right linear guide element, said linear guide elements each forming wedge-shaped projections extending relative to the inner side of the visor, said wedge-shaped projections being displaceably received in corresponding, wedge-shaped recesses in each of the two temple regions of the helmet shell. These wedge-shaped projections can also serve as receiving spaces for elements of the left and right bearing arrangement. As a result of the projections protruding inwards or in the direction of the temple regions of the head of a user, the outer side of the visor can be configured to extend as evenly or homogeneously as possible. This can also avoid disturbing wind noises and catching or injury-critical protuberances when using the sport helmet assembly.

In particular, the wedge-shaped recesses can be advantageously realized or received on the outside of the helmet shell if the helmet shell comprises a protective shell with an EPS (expanded polystyrene). The thickness of the helmet shell can be at least 10 mm, in particular at least 15 mm, for example between 10 mm and 30 mm, in the side or temple regions, inter alia, in which the wedge-shaped recesses are positioned.

According to an advancement, it is possible for the wedge-shaped projections on the inner side of the visor to form adjacent base surfaces facing one another, said base surfaces extending parallel to one another and being supported in a sliding manner on base surfaces extending parallel to one another in each of the two recesses in the helmet shell. As a result, elastic deformations of the visor during displacement of the visor relative to the helmet shell can be avoided or prevented. The manual displaceability of the visor relative to the helmet shell can thus be facilitated or made relatively easy to move. This can be particularly advantageous if the user is wearing gloves, for example when practicing winter sports.

Furthermore, it can be expedient for the linear guide elements each to be inserted into and held in an opening in the lateral end portions of the visor. In this case, the linear guide elements can be held, in particular latched, in a form-fitting manner in the respective openings of the visor. This enables a stable connection between the linear guide elements and the visor. In addition, the overall height of the left and right bearing arrangement for the visor can be kept low because the thickness of the visor is already used as a receiving space for the linear guide elements. In addition, the lightest possible construction of the bearing arrangements or of the visor can be achieved in this way.

Furthermore, it can be provided that the sealing element comprises a support body made of an elastomeric plastic, said support body being connected to the lower visor edge region, and that the sealing element further comprises a compensating body made of a comparatively soft foam plastic, which is fastened to the support body, said compensating body being provided to directly rest on or indirectly rest on the interposition of a thin felt or textile strip on the predetermined face portions of the user. As a result, a relatively high thickness of the sealing element can be created in relation to the normal direction to the inner side of the visor such that a wide range of different facial contours can be easily served. In addition, this makes it possible to provide a sufficiently or comfortably large distance between the inside of the visor and the facial areas covered by the visor, in particular the eye area. Due to the multi-compound structure of the sealing element, a good compromise can be reached between stability and the ability of the sealing element to absorb or compensate.

Furthermore, it can be provided that the left and right pivot axis are defined by a left and right screw, which are screwed to the helmet in a fixed position. This makes it possible to create pivot axes that are robust, functionally reliable in the long term and implementable in a cost-effective manner at the same time.

According to a particular embodiment, it is possible for the left and right screw to each pass through a left and right sliding block, wherein the left and right linear guide element are relatively displaceable with respect to the left and right sliding block, representing in particular guide partners or guide parts for the left and right linear guide element, and said sliding blocks are pivotable about screw axes of the left and right screw.

According to an advantageous advancement, it can be provided that the left and right linear guide element and the left and right spring element are each covered by a left and right cover element arranged on the outside of the visor. As a result, the intended function of the bearing device for the visor can be reliably maintained even under adverse environmental conditions, for example during snowfall or under icy conditions. These spring elements can be configured in particular as helical springs and thus provide a defined spring or restoring force with respect to the visor with a compact or space-saving structural volume.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
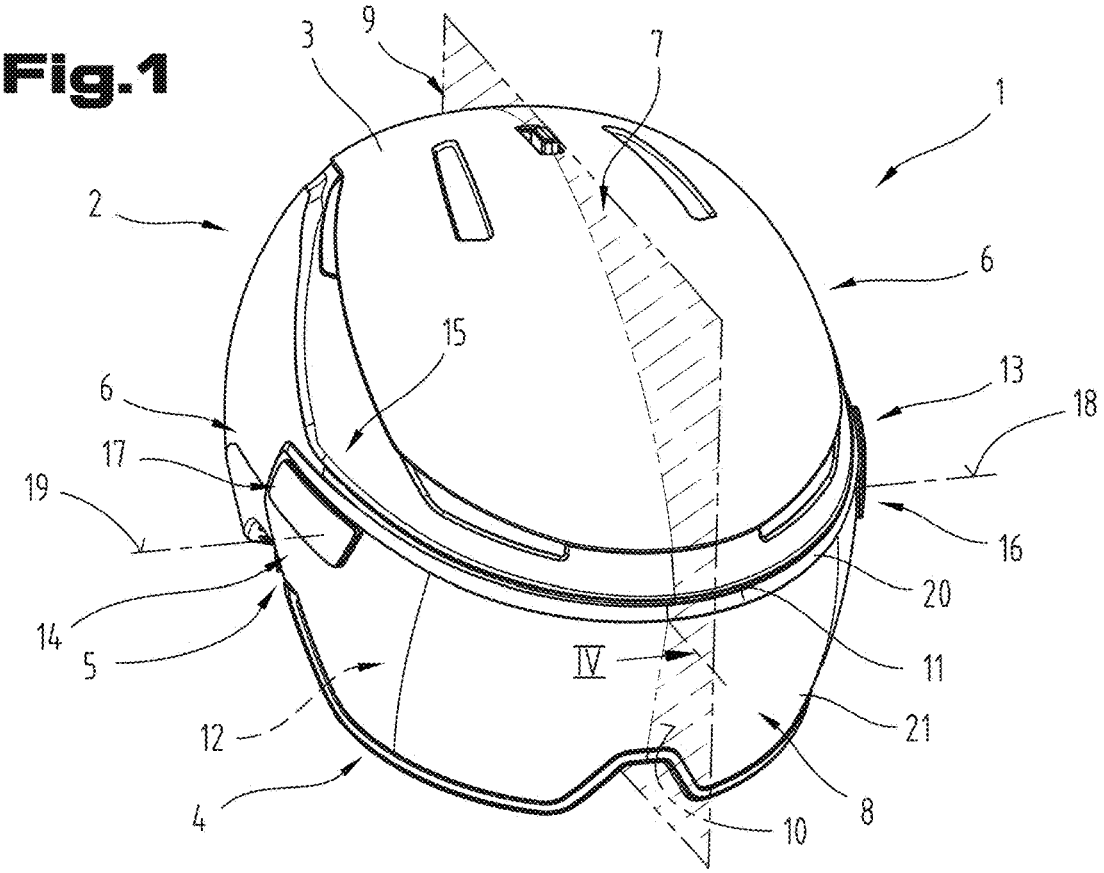
FIG. 1 shows an oblique perspective view from above of an embodiment of the sport helmet assembly.

It is worth noting here that the same parts have been given the same reference numerals or same component designations in the embodiments described differently, yet the disclosures contained throughout the entire description can be applied analogously to the same parts with the same reference numerals or the same component designations. The indications of position selected in the description, such as above, below, on the side etc. refer to the figure directly described and shown, and these indications of position can be applied in the same way to the new position should the position change.

FIGS. 1 to 7 show a possible embodiment of a sport helmet assembly 1, which can be used primarily for winter sports, but also for summer sports. These winter sports can include skiing, snowboarding, ice hockey, etc. among others. Cycling, skateboarding, water sports etc. can be seen as summer sports, for example.

The sport helmet assembly 1 comprises at least one helmet 2 with a helmet shell 3 and a visor 4 that can be pivoted and also adjusted in a translational manner relative to the helmet shell 3. The helmet 2 can further comprise fastening means (not shown), such as a chin strap for holding and securing the helmet 2 to the head of a user (not shown), and/or lateral tabs for protecting the ears of the user from the cold. A lining is usually provided, in particular a padding is arranged or received, for the head of the user in a receiving space 5 formed by the helmet shell 3. To adjust width and correspondingly adjust to the head circumference of the user, a head width adjustment device (FIG. 2) can be provided. Since the components or units described immediately above are not directly related to the present invention, these have not been provided with their own reference numerals.

The helmet 2 with its helmet shell 3 is not configured as a full-face or integral helmet, but rather in the manner of a hollow dome or in the manner of a half-shell helmet, wherein the helmet shell 3 extends laterally, namely on the left and right sides forming at least one temple region 6, and at least also covers the latter in sections for the user. The helmet shell 3 and/or the padding can also extend over an ear area or form the latter on both sides. The helmet 2 or its helmet shell 3 further defines a helmet shell upper side 7, a front side 8 and a rear head side 9 in the normal position of use and when the user is standing upright. For a better and simpler definition of indications of position and arrangements with respect to one another, a central plane 10 is defined. In the aforementioned position of use, the central plane 10 forms a vertical plane, which is arranged to extend centrally between the two temple regions 6. The central plane 10 further extends from the front side 8 towards the rear head side 9 of the helmet 2 or its helmet shell 3.

On its front side 8, the helmet shell 3 with a helmet shell edge 11 defines a facial clearance 12, which extends over a forehead region up to the two temple regions 6. The facial clearance 12 serves to release and not cover at least a sub-portion of the forehead of the user, the eye area, and preferably also the nose of the user. When in the protective position or closed position, the visor 4 (FIGS. 1, 2) should be able to cover at least the eye area and, if necessary, also the nose of the user.

The visor 4 comprises a substantially arcuately curved disk made of a transparent or sheer, in particular translucent, plastic.

As already stated above, the visor 4 is mounted on the helmet shell 3 in both an articulated or pivotable and displaceable manner. This mounting is carried out by means of the two end portions, namely a left end portion 13 and a right end portion 14 of the visor 4. A bearing device 15 is provided for this purpose, which itself comprises a left bearing arrangement 16 and a right bearing arrangement 17. Each of the bearing arrangements 16, 17 is also arranged or formed in the respective temple region 6 of the helmet 2. These are mostly independent components or component parts. The left bearing assembly 16 defines or forms a left pivot axis 18 and the right bearing assembly 17 defines or forms a right pivot axis 19 for the visor 4. mounted thereon. The pivot axis 18, 19 can be formed by a physical axis or can represent only an imagined axis. The left pivot axis 18 and the right pivot axis 19 are preferably aligned or at least approximately aligned.

The visor 4 comprises or forms an upper visor edge region 20 and a lower visor edge region 21. The two visor edge regions 20, 21 extend between the two end portions 13, 14 of the visor 4. The visor 4 has a curved or arcuate longitudinal extension over its circumferential extension between the two end portions 13, 14 or the bearing arrangements 16, 17. The lower visor edge region 21 can be made to face the nose or chin of the user, in particular such as the former is closer to these body portions than the upper visor edge region 20.

As a result of the pivotable and also relatively displaceable mounting of the visor 4 on the helmet shell 3 of the helmet 2, the visor 4 can be pivoted, as required, about the pivot axes 18,19 between a closed position (protective position) substantially or completely covering the facial clearance 12, and an open position (release position) substantially or completely releasing the facial clearance 12 and vice versa. The two positions (closed position and open position) each define maximum positions, between which intermediate positions of the visor 4 are also possible. In the covering closed position (FIGS. 1 to 4), substantially is understood to mean more than 50%, preferably up to 80%, 90% of the facial clearance 12 of the helmet shell 3 is overlaid or is even completely covered. In the open position (FIG. 5E), it is understood that more than 50%, preferably up to 80%, 90% of the facial clearance 12 of the helmet shell 3 is not covered and is thus free. The facial clearance 12 can also be completely released by the visor 4, thus providing no cover whatsoever.

Figure 2:
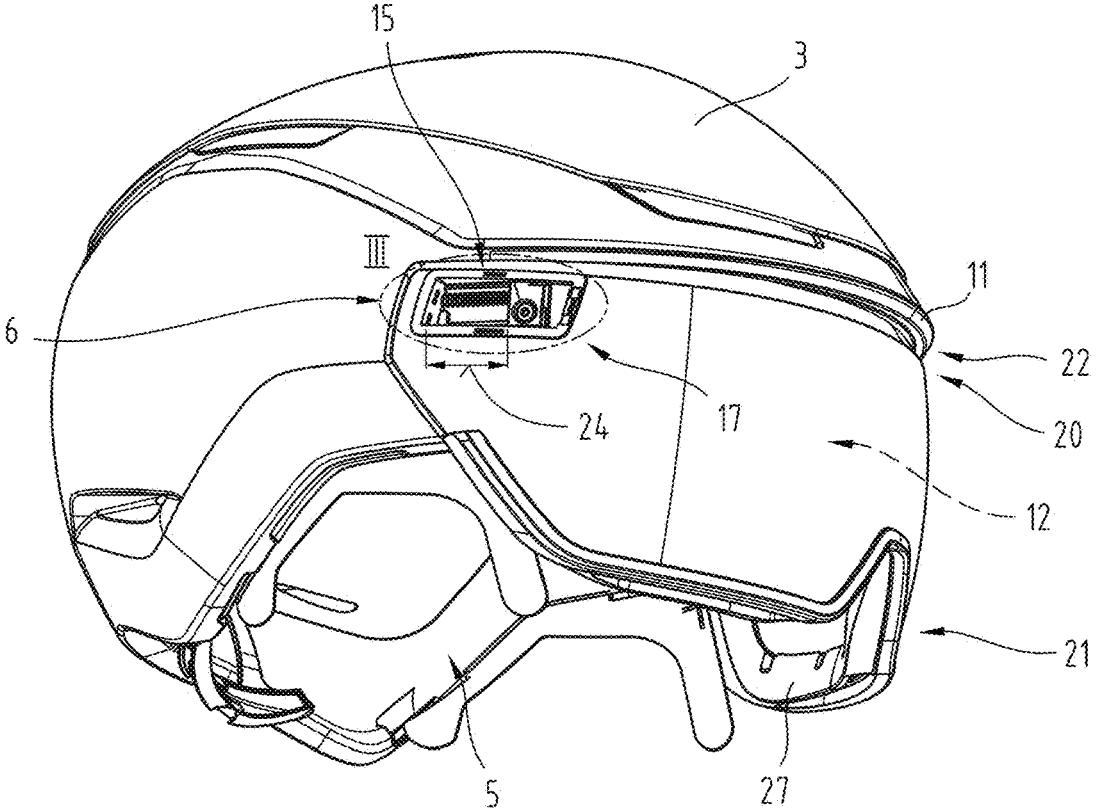
FIG. 2 shows an oblique perspective view from below of the sport helmet assembly according to FIG. 1.
Figure 3:
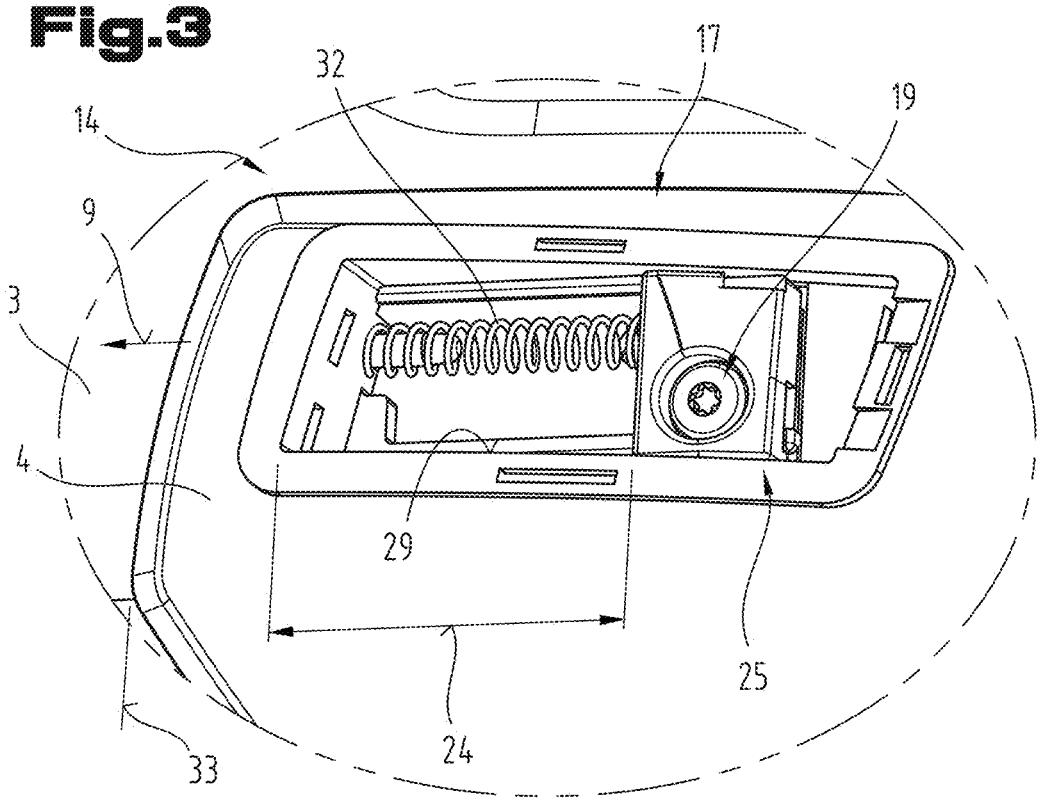
FIG. 3 shows the right bearing arrangement for the visor of the sport helmet assembly with the cover element removed.
Figure 4:
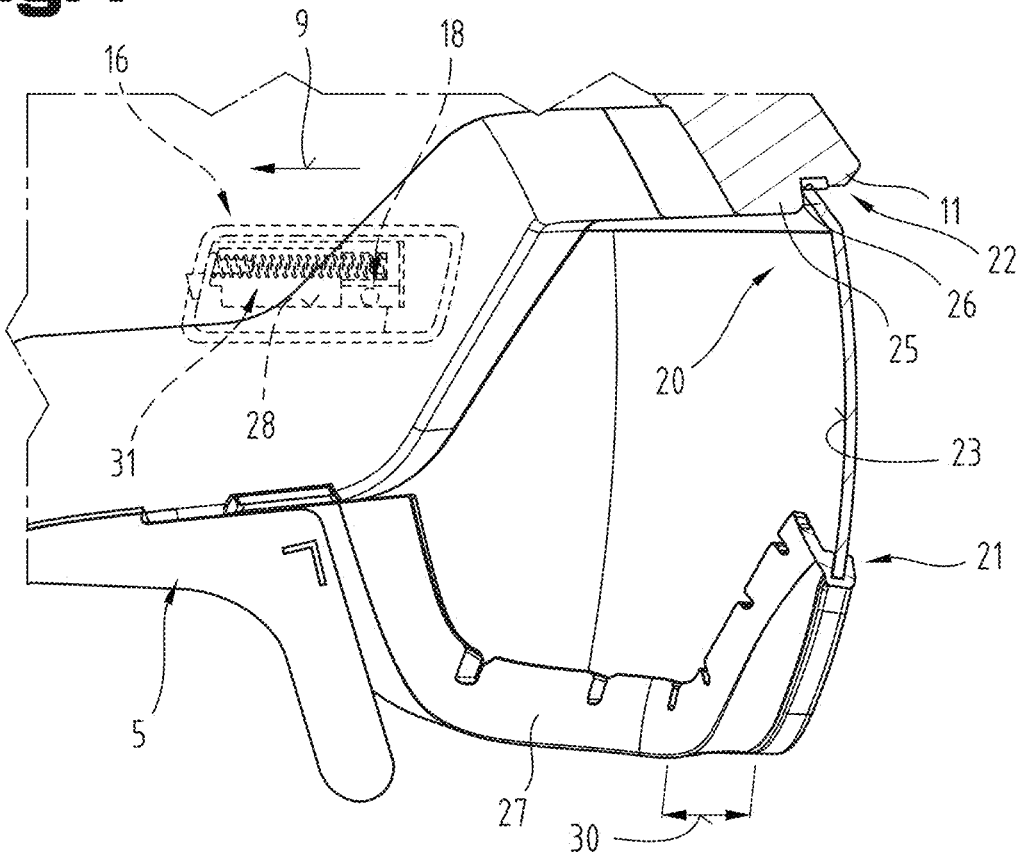
FIG. 4 shows a partial vertical section through the sport helmet assembly according to FIG. 1.

If the visor 4 is in its closed position, a protrusion 22 on the helmet shell 3 or on the side of the helmet shell 3 itself can project beyond the upper visor edge region 20 of the former, at least in the region of the central plane 10, as can best be seen in FIGS. 2 and 4. The protrusion 22 that is roof like or acts in a similar way to a roof overhang relative to the upper visor edge region 20 is located at least in the region of or along the helmet shell edge 11 delimiting the facial clearance 12. This protrusion 22 relative to the upper edge of the visor 4 can serve as drip protection or prevent snow or moisture from penetrating into the receiving space 5 or onto an inner side 23 of the visor 4. In the closed position of the visor 4, it can be expedient for the helmet shell-side protrusion 22 to extend relative to the visor 4 over at least 40%, preferably over 50% to 80%, particularly preferably over 50% to 100% of a length of the upper boundary edge of the visor 4 or of the upper visor edge region 20. As a result, it is possible to dispense with an elastic seal or a sealing stop surface on the upper helmet shell edge 11 or on the upper visor edge region 20 yet still achieve a sufficient and satisfactory sealing effect between the upper helmet shell edge 11 and the upper visor edge region 20.

A maximum available translational travel range of the visor 4, in particular a maximum available displacement length 24 of the visor 4 in the direction of the rear head side 9 can be limited by a rear limiting stop 25, said rear limiting stop 25 can be formed or arranged on the left and right bearing arrangement 16, 17 (FIG. 3) and/or in the region of the upper helmet shell edge 11 or protrusion 22 (FIG. 4). Where applicable, the limiting stop 25 formed in the region of the upper helmet shell edge 11 can be configured as a support surface 26 formed or configured to extend at an angle, in particular a right angle, to the protrusion 22 for the upper visor edge region 20 (FIG. 4).

In the lower visor edge region 21, a sealing element 27 is provided on the visor 4 (FIGS. 2, 4), which is arranged between the visor 4 and the face, in particular between the visor 4 and sub-portions of the facial skin of the user in the closed position of the visor 4. By doing so, the ingress of drafts, snow, water, dirt or the like into the receiving space 5 can be prevented or minimized. The sealing element 27 is usually configured with a flat-shaped profile or in a rod-shaped manner and is formed from a material with a low modulus of elasticity. For this reason, the sealing element 27 can be deformed easily and also has self-resetting properties after deformation and release. The sealing element 27 is arranged on the visor 4 so as to extend along the lower visor edge region 21 at least in sections. The arrangement or attachment to the visor 4 can take place such that the sealing element 27 starting from an inner surface of the visor 4 facing the rear head side 9 of the helmet shell 3 is arranged so as to protrude in the direction of the rear head side 9 of the helmet shell 3. The sealing element 27 can be plugged into and/or glued on in the lower visor edge region 21.

As already explained above, the left bearing arrangement 16 and the right bearing arrangement 17 are each configured in the manner of sliding joints. Correspondingly, the left bearing arrangement 16 has a left sliding guide 28 in addition to the left pivot axis 18 and the right bearing arrangement 17 has a right sliding guide 29 in addition to the right pivot axis 19 such that the visor 4 can be pivoted and displaced relative to the helmet shell 3 from the closed position into an open position—and vice versa—by means of the bearing arrangements 16,17 during a manually executed displacement movement.

The at least one sealing element 27 in the lower visor edge region 21 can be configured in a single-part or multi-part manner. In particular, this can be formed from a homogeneous foam plastic. The sealing element 27 is preferably formed from several soft-elastic or elastically resilient materials, which can be constructed in a sandwich-like manner or can be arranged overlying one another. A thickness 30 of the single-part or multi-part sealing element 27 is measured from the inner side 23 of the visor 4 in the direction of the rear head side 9.

An available displacement length 24 of the left and right sliding guide 28,29 and a thickness 30 of the sealing element 27 measured from the inner side 23 of the visor 4 in the direction of a rear head side 9 of the helmet 2 are dimensioned such that the sealing element 27 can be pressed against face portions below the eyes of the user in the closed position of the visor 4 by means of the left and right sliding guide 28, 29. In particular, the linear or slightly arcuate sliding guides 28, 29 for providing the respective displacement length 24 of the visor 4 are dimensioned such that the sealing element 27 can press against a large number or at least a majority of head sizes or face shapes of users or can be pressed against the face portions below the eye region and can thus ensure good sealing of the eye region against drafts or cold air. In the closed position of the visor 4 (FIGS. 1 to 4), at least sub-portions of the length of the sealing element 27 are to be pressed slightly against the corresponding skin surfaces in the nose region and/or in the region below the eyes of the user, thus avoiding or minimizing the entry of cold air or drafts from the lower visor edge region 21 into the space between the inner side 23 of the visor 4 and the part of the face covered by the visor 4. This can be particularly advantageous when skiing, as it ensures increased comfort and increased safety of use, among other things.

Figure 5A:
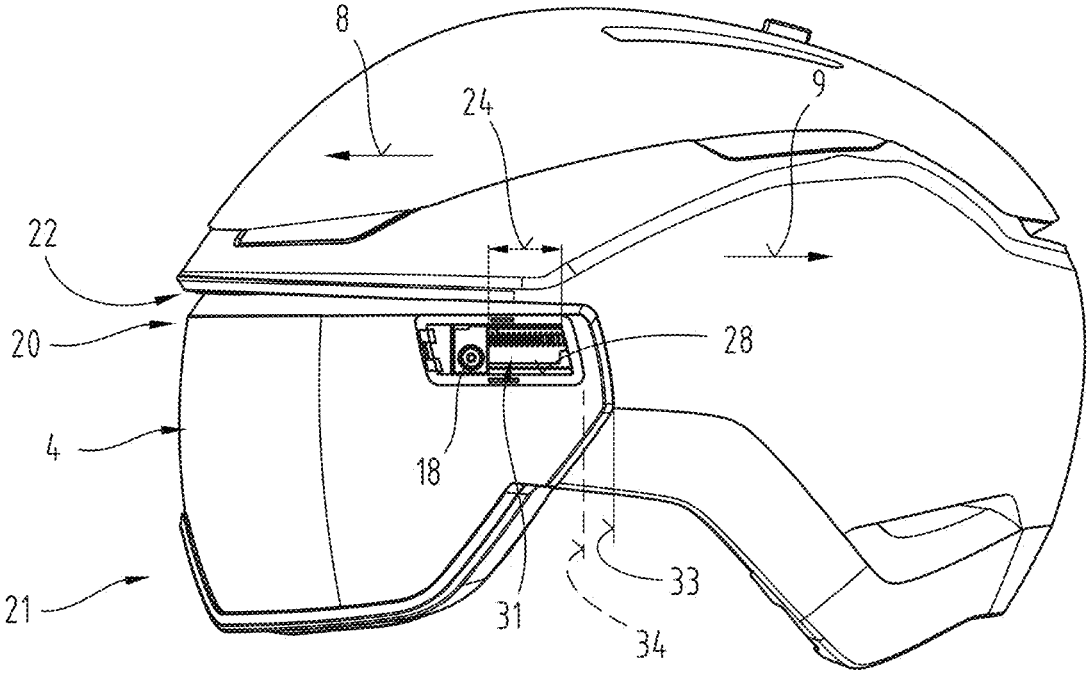
FIGS. 5A, 5B, 5C, 5D, and 5E show individual movement sequences of the visor starting from a closed position of the visor of the sport helmet assembly according to FIG. 1 to an open position of the visor.

In order to achieve a continuous or controlled pressing force of the visor 4 or its sealing element 27 against the face of a user, it is expedient for at least one of the two sliding guides 28 or 29, preferably both the left and the right sliding guides 28 and 29, to each be assigned at least one spring element 31, 32. The at least one spring element 31, 32 acts in such a way that the visor 4 is continuously pushed in the direction of an end position 33—FIG. 3, FIG. 5A—closest to the rear head side 9. As described above, the thickness 30 of the sealing element 27 and the maximum available displacement length 24 of the sliding guides 28, 29 are dimensioned such that, in its closed position, the visor 4 can assume a pressing position 34 relative to a face of the respective user, as shown by way of example in FIG. 6. Various head sizes or facial contours are at least partially compensated for by the sliding guides 28, 29 and by the sealing element 27. In comparison, FIG. 5A shows the maximum stop-limited end position 33 of the visor 4 with respect to the rear head side 9 of the helmet 2 because, in the state shown in FIG. 5A, a head of a user is not received in the helmet 2, i.e. the sport helmet assembly 1 is not being used. The stop limit or the pressing position 34 of the visor 4, which can be adjusted in a translational manner, in the direction of the rear head side 9 is defined by the facial surfaces of the user in the state of use according to FIG. 6 In this case, the pressing force is substantially determined by the spring force of the at least one spring element 31, 32.

Figure 5B:
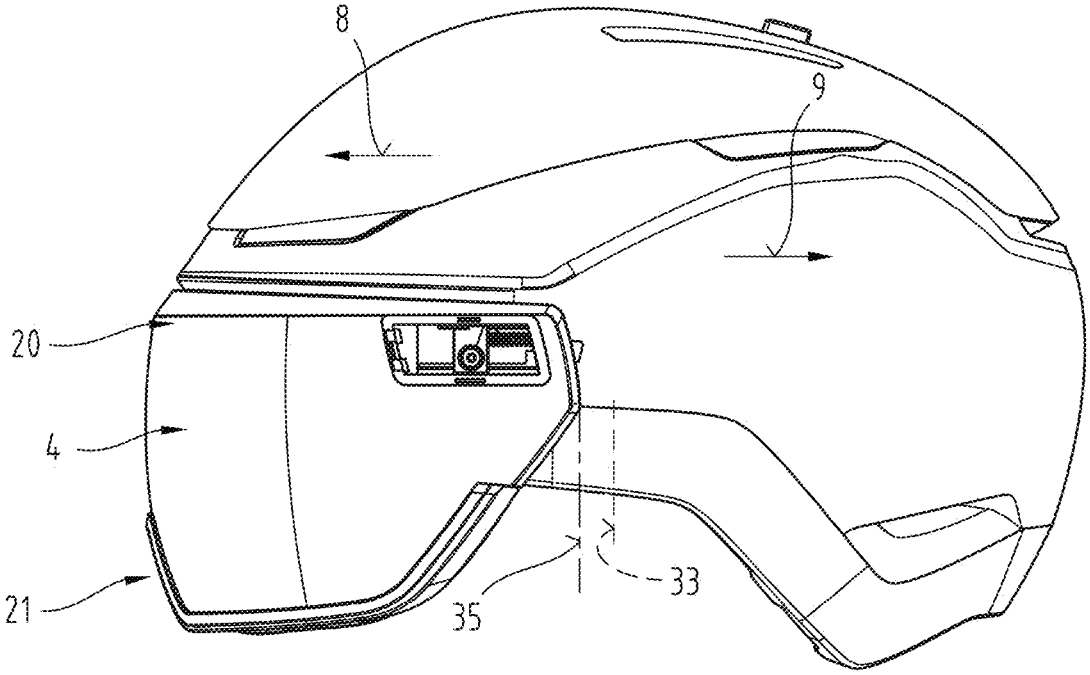
Figure 5C:
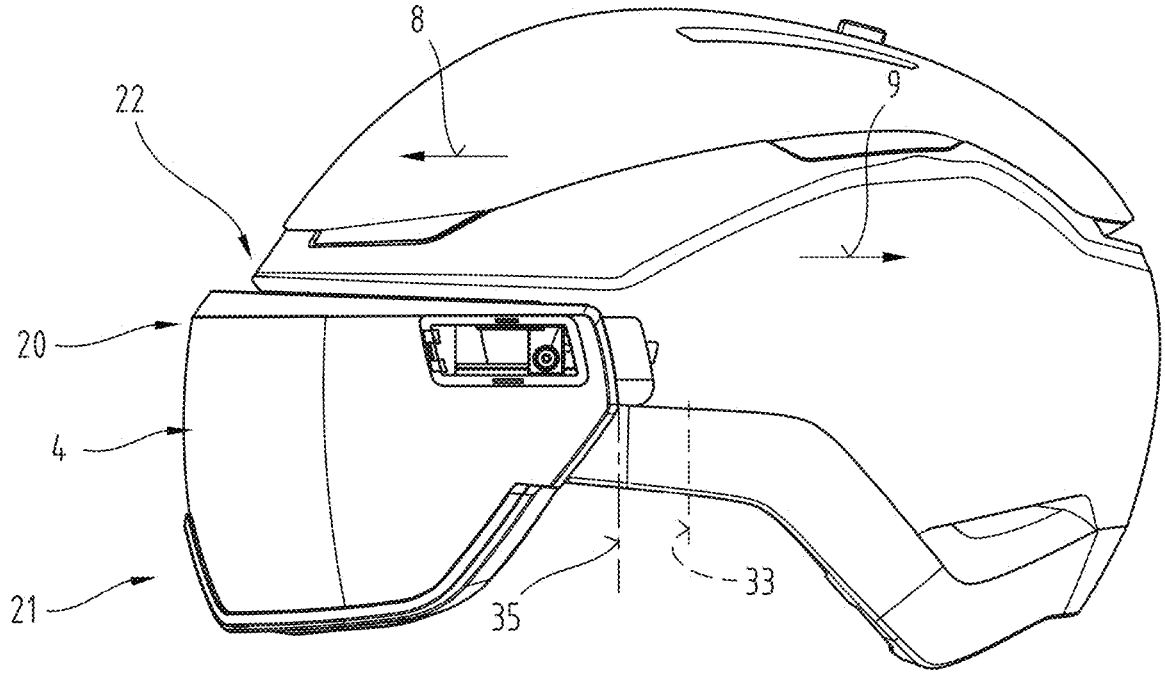
Figure 5D:
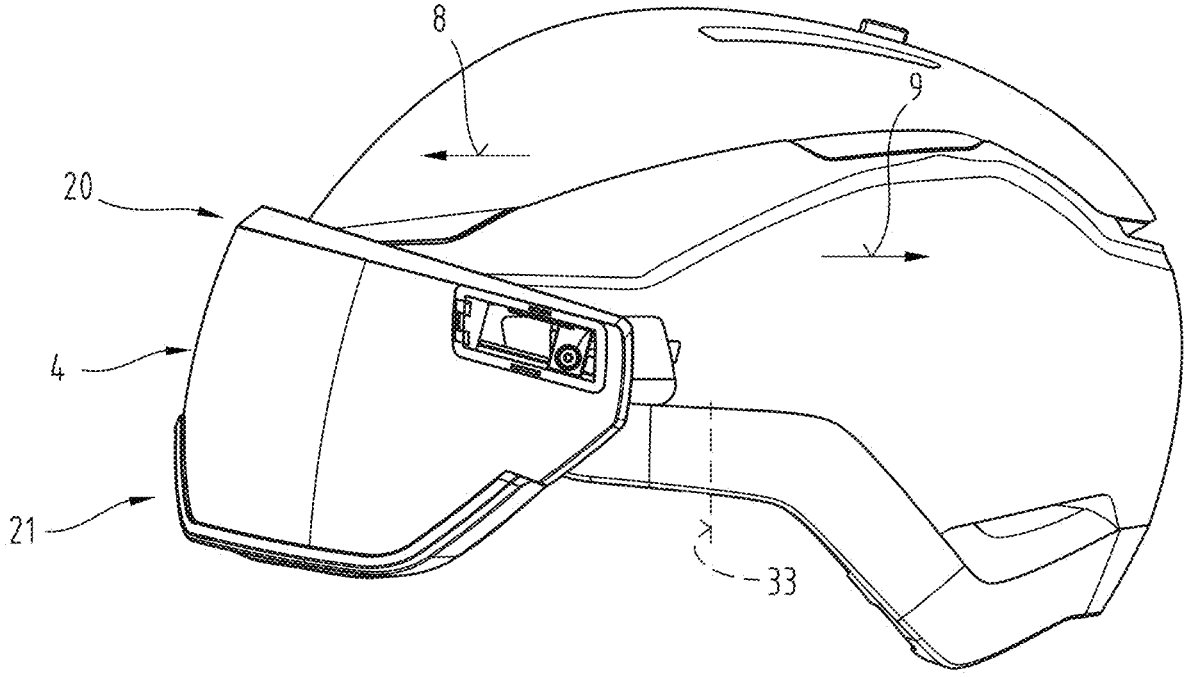

The spring force of the at least one spring element 31, 32 can be dimensioned such that the visor 4 can be displaced into distance positions 35 comparatively further away from the rear head side 9 by the user by gripping the visor 4, in particular by grasping the visor 4 in each of the two temple regions 6, as is shown by way of example with dashed lines in FIG. 5B and FIG. 5C. In the state according to FIG. 5C, the distance position 35 of the visor 4 is further away from the rear end position 33 than in the state according to FIG. 5B.

As can be seen in FIG. 5A and FIG. 5B, the sport helmet assembly 1 can be configured such that in the closed position of the visor 4, the helmet shell edge 11 projects beyond the upper visor edge region 20 in the direction of the front side 8, at least in sections, in particular at least in the central portion between the left and right bearing assembly 18 and 19. In this way, in the closed position, pivoting of the visor 4 at least in the direction of the open position, i.e. upwards, is blocked or prevented in a stop-limited manner by the projecting helmet shell edge 11 so as to achieve high robustness of the sport helmet assembly 1 or relief of the bearing arrangements 18, 19. The helmet shell edge 11 protruding beyond the visor 4 can be formed, at least in sections, by the aforementioned protrusion 22.

FIGS. 5A to 5E depict a sequence of movements of the visor 4 starting from its closed position (FIG. 5A) to its open position (FIG. 5E), i.e. show a folding-up movement of the visor 4 that can be performed by the user.

Figure 6:
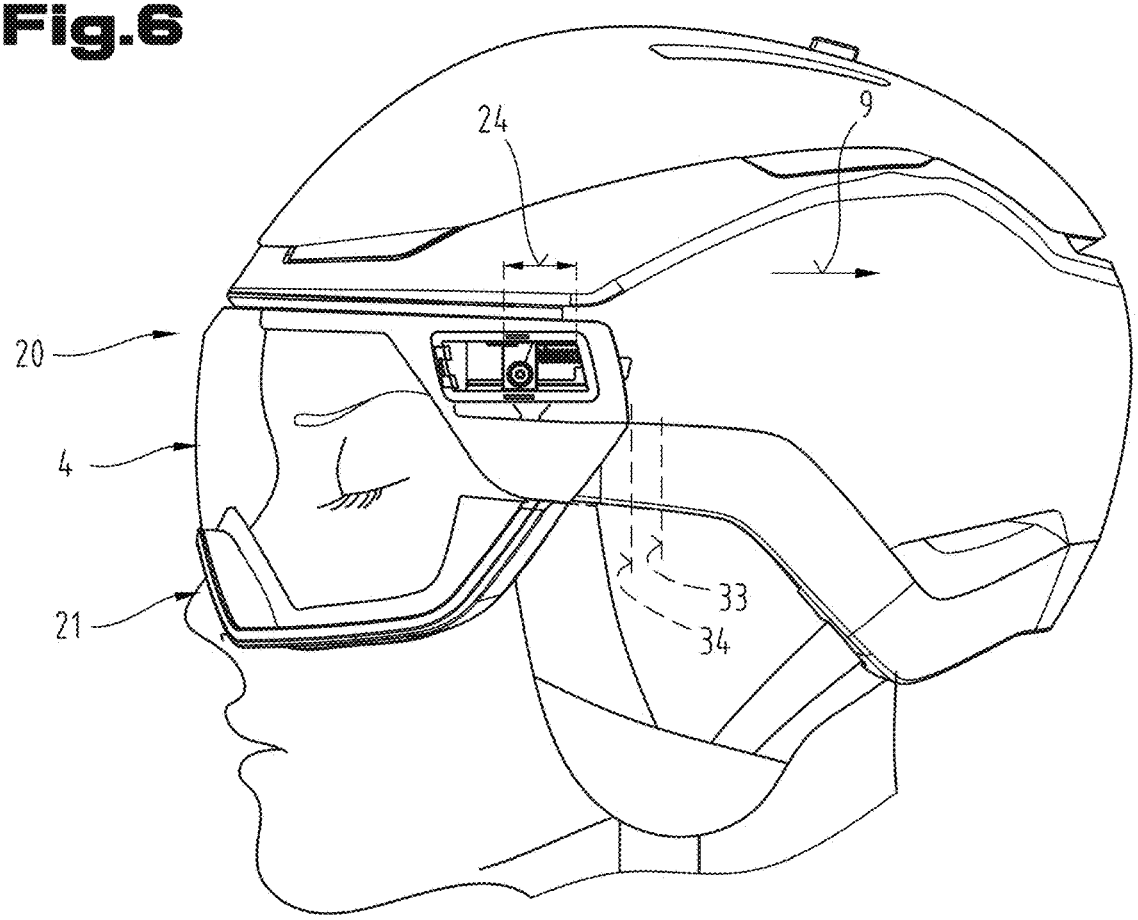
FIG. 6 shows the sport helmet assembly according to FIG. 1 worn on a head of a user, wherein the visor is pressed against and supported on facial surfaces of the user.

In FIG. 5A, the visor 4 assumes the rear end position 33 due to the effect of the spring elements 31, 32 in conjunction with the sliding guides 28, 29 (FIGS. 3, 4), due to the fact that no facial surfaces of a user are present that would define a pressing position 34 of the visor 4 arranged in front, for example, according to FIG. 6.

Figure 5E:
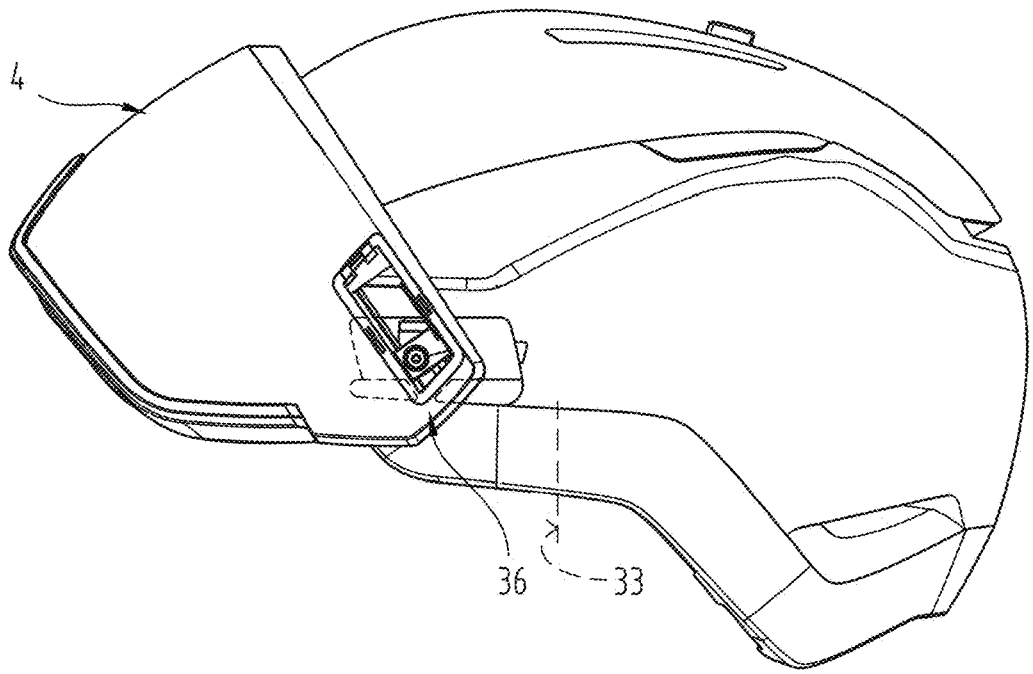

FIG. 5B and FIG. 5C show how the visor 4 can be displaced in a translational manner by a user in the direction of the front side 8, or forwards using the sliding guides 28, 29, and how an actuating force is to be applied counter to the spring force of the spring elements 31, 32. From a predetermined adjustment distance or distance position 35 of the visor 4 relative to the rear head side 9, the visor 4 is released from the helmet shell edge 11 or is no longer limited in the upward direction by the protrusion 22 and the user can then initiate the upward folding movement of the visor 4 using the pivot axes 18, 19 according to FIG. 5D. FIG. 5E depicts a folded-up position, i.e. an open position of the visor 4.

Furthermore, the left and/or right bearing arrangement 16, 17 can comprise at least one latching element 36 (FIG. 5E), which is configured to fix the open position of the visor 4 without the user having to exert a continuous holding force on the visor 3. A plurality of latching elements 36 spaced-apart from one another can be provided in order to define different open positions or angular positions of the visor 4 relative to the helmet shell 3. As soon as the user disengages the at least one latching element 36 or overrides it with a release movement, the visor 4 can be returned to its closed position or pressing position 34 with respect to the face, for example according to FIG. 6. In this case, it can be provided that the return movement of the visor 4 from the open position (FIG. 5E) into the end position (FIG. 5E) or into a pressing position 34 in front (FIG. 6) is based at least in part on the spring force of the at least one spring element 31, 32.

Figure 7:
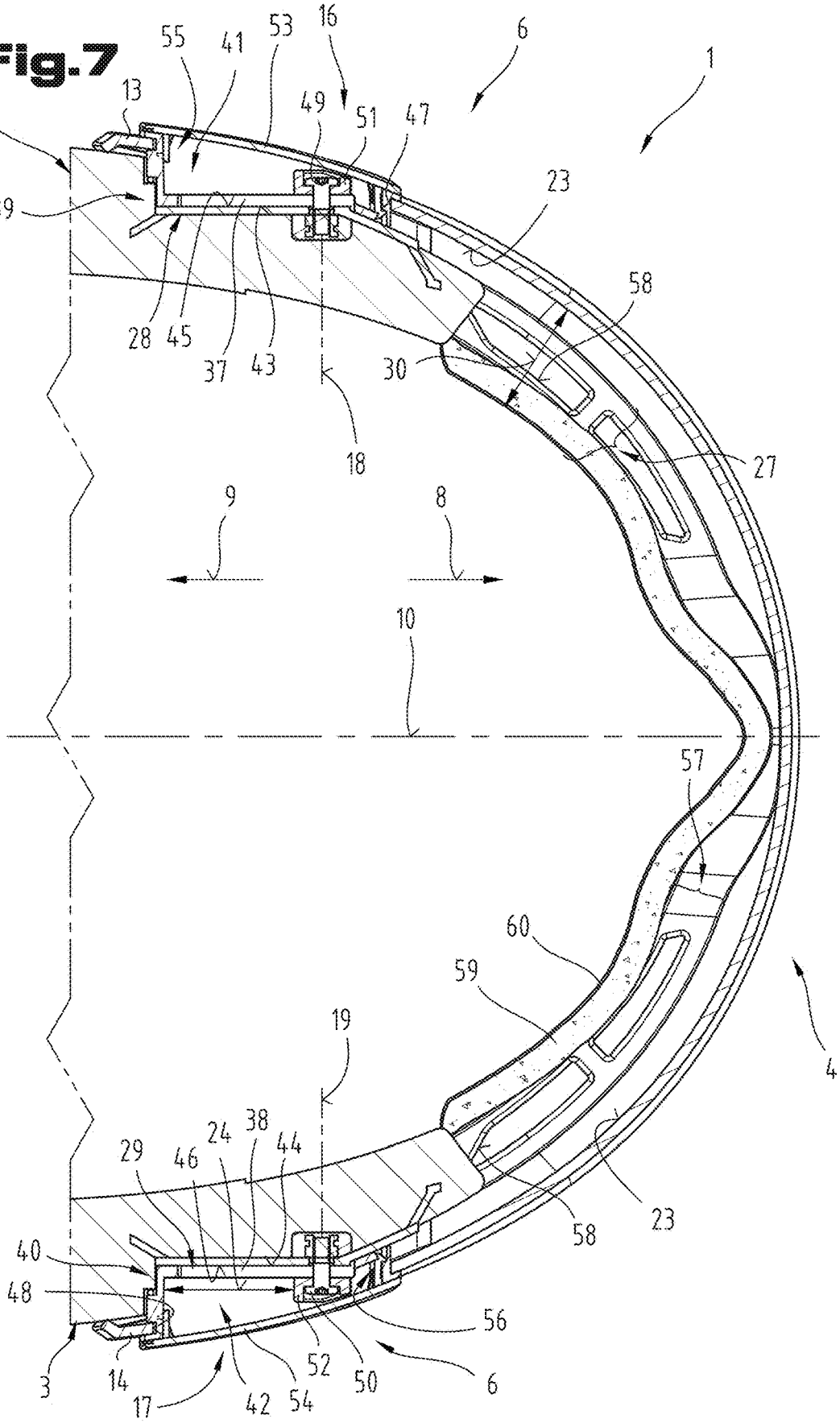
FIG. 7 shows a horizontal section through the sport helmet assembly according to FIG. 1 in the region of the two bearing assemblies for the visor.

FIG. 7 shows an advantageous embodiment of the left and right sliding guides 28, 29 for the visor 4 in longitudinal section. The left and right sliding guides 28, 29 can be configured in a mirror-image manner of the vertical central plane 10 of the sport helmet assembly 1.

The left sliding guide 28 comprises a left linear guide element 37 and the right sliding guide 29 comprises a right linear guide element 38, said linear guide elements 37, 38 are mounted on the visor 4 and each form wedge-shaped projections 39, 40 with relative to the inner side 23 of the visor 4. These wedge-shaped projections 39, 40 are displaceably received in corresponding, wedge-shaped recesses 41, 42 in each of the two temple regions 6 of the helmet shell 3. The helmet shell 3 is illustrated in this case including an inner lining or padding and has a sufficient thickness to be able to form the recesses 41, 42 on the outside of the helmet shell 3.

The wedge-shaped projections 39, 40 on the inner side 23 of the visor 4 can form base surfaces 43, 44 that are adjacent or face one another, said base surfaces 43, 44 extending parallel or largely parallel to one another. These base surfaces 43, 44 extending as parallel to one another as possible on the visor inner side 23 are supported in a slidable manner on base surfaces 45, 46 that extend parallel or largely parallel to one another, in each of the two recesses 41, 42 in the helmet shell 3. Accordingly, the visor 4 can be slidably displaced with its base surfaces 43, 44 in the direction of the front side 9 and also in the direction of the rear head side 9 relative to the helmet shell 3.

It is expedient for the linear guide elements 37, 38 configured in a frame-like manner, for example, to be inserted into and held in a respective opening 47, 48 in the lateral end portions 13, 14 of the visor 4. This holder can be expediently implemented as a positively acting latching connection between the linear guide elements 37, 38 and the visor 4 (shown by way of example).

As can further be derived from FIG. 7, it can be expedient for the left and right pivot axis 18, 19 for the visor 4 to be defined by a left and right screw 49, 50, which are screwed in a fixed position to the helmet 2 or to the helmet shell 3. These screws 49, 50 can be held in screw inserts, said screw inserts being able to be anchored simply in the helmet shell 3 yet protected from being ripped out.

In order to achieve a robust and smooth-running sliding and pivoting bearing (sliding joint) that is wear free in the long term for the visor 4, it can be provided that the left and right screw 49, 50 each pass through a left and right sliding block 51, 52 and thereby support these sliding blocks 51, 52 rotatably about their screw axes. In addition, the left and right linear guide element 37, 38 on the visor 4 are relatively displaceable relative to the left and right sliding block 51, 52. The screw axes of the left and right screw 49, 50 define the left and right pivot axis 18, 19, which are fixed in position on the helmet shell 3.

The sliding blocks 51, 52 and the screw heads of the screws 49, 50 are received in the wedge-shaped projections 39, 40 formed on the inner side 23 of the visor 4, which form defined receiving spaces tapered in a wedge shape. The same applies to the spring elements 31, 32 shown in FIGS. 2 to 4. In order to ensure proper function even under adverse conditions, it can be expedient for at least the left and right linear guide element 37, 38 and the left and right spring element 31, 32 to each be covered by a left and right cover element 53, 54 arranged on the outside of the visor 4. The cover elements 53, 54 can be positively coupled to the visor 4 or to the linear guide elements 37, 38 of the visor 4 by means of corresponding latching couplings 55, 56.

As can also be seen from the embodiment according to FIG. 7, it can be expedient for the at least one sealing element 27 in the lower visor edge region 21 to have a multi-part or multi-layer structure. In particular, the sealing element 27 can comprise a support body 57 made of an elastomeric plastic, said support body 57 preferably being positively connected to the lower visor edge region 21. The support body can comprise ventilation openings, which are preferably covered by a flow-reducing foam plastic (not shown). The multi-part sealing element 27 further comprises a compensating body 59 made of a comparatively soft foam plastic, which is fastened to the support body 57, said compensating body 59 being provided to directly rest on or indirectly rest on the interposition of a thin felt or textile strip 60 on the predetermined face portions of the user.

The embodiments show possible design variants, however it is noted at this point that the invention is not restricted to the design variants of the same specifically shown, rather various combinations between the individual design variants are possible and these possible variants can be developed using the knowledge of the person skilled in the art working in this field based on the teachings of technical practice offered by the current invention.

The scope of protection is determined by the claims. However, the description and the drawings are to be referenced for the interpretation of the claims. Individual features or combinations of features from the various exemplary embodiments shown and described can represent independent inventive solutions in themselves. The problem to be solved, upon which the independent, inventive solutions are based, can be derived from the description.

As a matter of form and by way of conclusion, it is noted that, to improve understanding of the structure, elements have partially not been shown to scale and/or enlarged and/or shrunk.

Although only a few embodiments of the present invention have been shown and described, it is to be understood that many changes and modifications may be made thereunto without departing from the spirit and scope of the invention.

List of Reference Numerals

1 Sport Helmet Assembly
2 Helmet
3 Helmet shell
4 Visor
5 Receiving space
6 Temple region
7 Helmet shell upper side
8 Front side
9 Rear head side
10 Central plane
11 Helmet shell edge
12 Facial clearance
13 Left end portion
14 Right end portion
15 Bearing device
16 Left bearing arrangement
17 Right bearing arrangement
18 Left pivot axis
19 Right pivot axis
20 Upper visor edge region
21 Lower visor edge region
22 Protrusion
23 Inner side
24 Maximum displacement length
25 Rear limit stop
26 Support surface
27 Sealing element
28 Left sliding guide
29 Right sliding guide
30 Thickness
31 Spring element
32 Spring element
33 End position
34 Pressing position
35 Distance position
36 Latching element
37 Left linear guide element
38 Right linear guide element
39 Projection
40 Projection
41 Recess
42 Recess
43 Base surface
44 Base surface
45 Base area
46 Base area
47 Opening
48 Opening
49 Screw
50 Screw
51 Sliding block
52 Sliding block
53 Cover element
54 Cover element
55 Latching coupling
56 Latching coupling
57 Support body
58 Ventilation openings
59 Compensating body
60 Felt or textile strip

What is claimed is:

1. A sport helmet assembly (1) comprising a helmet (2) with a helmet shell (3), said helmet (2) being configured to at least partially receive a head of a user to be protected, and the helmet shell (3) on its front side (8) with a helmet shell edge (11) defines a facial clearance (12) limited upwards, and this facial clearance (12) is not limited downwards by the helmet shell (3), and the helmet shell (3) further forms a helmet shell upper side (7) as well as a temple region (6) on each side, a visor (4), said visor (4) having an upper visor edge region (20) and a lower visor edge region (21), wherein the lower visor edge region (21) can be turned to face closest to a nose or a chin of the user, a bearing device (15) with a left bearing assembly (16) and a right bearing assembly (17) for the visor (4), said bearing assemblies (16, 17) are each arranged or formed in one of the temple regions (6) on the helmet shell (3), and the left bearing assembly (16) defines a left pivot axis (18) and the right bearing assembly (17) defines a right pivot axis (19) so that the visor (4) can be displaced between a closed position, which substantially covers the facial clearance (12), and an open position, which substantially releases the facial clearance (12), and vice versa, and a form-elastic sealing element (27), which is secured in the lower visor edge region (21) of the visor (4) and extends at least in sections along the lower visor edge region (21), wherein, the left bearing assembly (16) has a left sliding guide (28) in addition to the left pivot axis (18), and wherein the right bearing assembly (17) has a right sliding guide (29) in addition to the right pivot axis (19) such that the visor (4) can be pivoted and displaced by means of the bearing assemblies (16, 17) during a manually executed displacement movement, and an available displacement length (24) of the left and right sliding guide (28, 29) and a thickness (30) of the sealing element (27) measured from an inner side (23) of the visor (4) in the direction of a rear head side (9) of the helmet (2) are dimensioned such that the sealing element (27) can be pressed against face portions below the eyes of the user in the closed position of the visor (4) by means of the left and right sliding guide (28, 29).

2. The sport helmet assembly according to claim 1, wherein at least one of the two sliding guides (28, 29) is assigned at least one spring element (31, 32), with said at least one spring element (31, 32) the visor (4) is pushed in the direction of an end position (33) closest to the rear head side (9).

3. The sport helmet assembly according to claim 2, wherein the spring force of the at least one spring element (31, 32) is dimensioned such that the visor (4) can be displaced into at least one distance position (35) comparatively further away from the rear head side (9) by the user by gripping the visor (4).

4. The sport helmet assembly according to claim 1, wherein, in the closed position of the visor (4), the helmet shell edge (11) projects beyond the upper visor edge region (20) at least in sections, in the direction of the front side (8).

5. The sport helmet assembly according to claim 1, wherein the left sliding guide (28) comprises a left linear guide element (37) and the right sliding guide (29) comprises a right linear guide element (38), said linear guide elements (37, 38) each forming wedge-shaped projections (39, 40) extending relative to the inner side (23) of the visor (4), wherein these wedge-shaped projections (39, 40) are displaceably received in corresponding, wedge-shaped recesses (41, 42) in each of the two temple regions (6) of the helmet shell (3).

6. The sport helmet assembly according to claim 5, wherein the wedge-shaped projections (39, 40) form adjacent base surfaces (43, 44) facing one another, said base surfaces (43, 44) extending parallel to one another and being supported in a sliding manner on base surfaces (45, 46) extending parallel to one another in each of the two recesses (41, 42) in the helmet shell (3).

7. The sport helmet assembly according to claim 5, wherein the linear guide elements (37, 38) are inserted into and held in a respective opening (47, 48) in the lateral end portions (13, 14) of the visor (4).

8. The sport helmet assembly according to claim 1, wherein the sealing element (27) comprises a support body (57) made of an elastomeric plastic, said support body (57) being connected to the lower visor edge region (21), and wherein the sealing element (27) further comprises a compensating body (59) made of a comparatively soft foam plastic, which is fastened to the support body (57), said compensating body (57) being provided to directly rest on or indirectly rest on the interposition of a thin felt or textile strip (60) on the specified face portions of the user.

9. The sport helmet assembly according to claim 1, wherein the left and right pivot axis (18, 19) are defined by a left and right screw (49, 50), which are screwed in a fixed position to the helmet (2).

10. The sport helmet assembly according to claim 9, wherein the left and right screw (49, 50) each passes through a left and right sliding block (51, 52), wherein the left and right linear guide element (37, 38) are relatively displaceable with respect to the left and right sliding block (51, 52) and said sliding blocks (51, 52) are pivotable about screw axes of the left and right screw (49, 50).

11. The sport helmet assembly according to claim 5, wherein the left and right linear guide element (37, 38) and the left and right spring element (31, 32) are each covered by a left and right cover element (53, 54) arranged on the outside of the visor (4).

12. The sport helmet assembly according to claim 1, wherein each of the left and the right sliding guides (28, 29) is assigned at least one spring element (31, 32), with said at least one spring element (31, 32) the visor (4) is pushed in the direction of an end position (33) closest to the rear head side (9).

13. The sport helmet assembly according to claim 2, wherein the spring force of the at least one spring element (31, 32) is dimensioned such that the visor (4) can be displaced into at least one distance position (35) comparatively further away from the rear head side (9) by the user by grasping the visor (4), in each of the two temple regions (6).

14. The sport helmet assembly according to claim 1, wherein, in the closed position of the visor (4), the helmet shell edge (11) projects beyond the upper visor edge region (20) at least in sections, in the direction of the front side (8), at least in the central portion between the left and right bearing assemblies (16, 17) such that, in the closed position, pivoting of the visor (4) at least in the direction of the open position is prevented by the projecting helmet shell edge (11) or blocked in a stop-limited manner.

* * * * *